US005751298A

United States Patent [19]

Crowley

[11] Patent Number: 5,751,298

[45] Date of Patent: May 12, 1998

[54] SYSTEM AND METHOD FOR DIRECTLY FEEDING PAPER TO PRINTING DEVICES

[75] Inventor: H. W. Crowley, Newton, Mass.

[73] Assignee: Roll Systems, Inc., Burlington, Mass.

[21] Appl. No.: 481,796

[22] Filed: Jun. 7, 1995

Related U.S. Application Data

[63] Continuation of Ser. No. 773,887, Jun. 24, 1991, which is a continuation-in-part of Ser. No. 536,214, Jun. 11, 1990, Pat. No. 5,130,724.

[51] Int. Cl.[6] ..... G03G 15/21

[52] U.S. Cl. ..... 346/136; 271/265.01; 271/266; 399/385; 399/394

[58] Field of Search ..... 347/104; 346/134, 346/136; 271/265.01, 266; 399/384, 385, 394, 396

[56] References Cited

U.S. PATENT DOCUMENTS 3,709,492 1/1973 Baker et al. ..... 355/309

4,863,154 9/1989 Hirakawa et al. ..... 271/265.02

4,874,161 10/1989 Murasaki et al. ..... 271/265.01

*Primary Examiner*—John E. Barlow, Jr.

*Attorney, Agent, or Firm*—Cesari and McKenna, LLP

[57] ABSTRACT

A unique system and method for directly feeding sheets into a printing device having a moving image conducting element with a plurality of images placed thereon for transfer to sheet paper and having a wait station for controlling the timing of paper transfer to the image conducting element provides a feeding table to transfer sheets from a source to a printer stack deshingler while bypassing and, thus, eliminating any need for sheet stacks. The movement of each sheet by the wait station into the image transfer element signals the cutting of a sheet from a roll of continuous web on the input side of the feeding table. Once the sheet has moved into the image transfer element the absence of a sheet at the detector signals transfer by the feeding table of the cut sheet to the stack deshingler. Simultaneously, a source of web presents and end of the web representing another sheet to a cutting unit. This sheet is cut when the current sheet at the wait station begins movement into the image transfer element.

7 Claims, 3 Drawing Sheets

SYSTEM AND METHOD FOR DIRECTLY FEEDING PAPER TO PRINTING DEVICES

This application is a continuation of application Ser. No. 07/773,887 filed on Jun. 24, 1991, which in turn is a continuation-in-part of application Ser. No. 07/536,214, filed Jun. 11, 1990, now U.S. Pat. No. 5,130,724.

FIELD OF THE INVENTION

This invention relates to a novel system and unique method for feeding a continuous stream of paper to a printing device without any need for stacking and deshingling individual sheets of paper.

BACKGROUND OF INVENTION

It is desirable to input materials such as paper to a printing operation in continuous form such as fan folded or roll form. The use of a roll, rather than sheets, allows longer intervals between reloading of the paper source. Roll fed paper, cut just prior to feeding, allows sheets to be various sizes without the need to change the size of the paper loaded in the stack. The use of a paper source roll also reduces packaging waste since stacked paper sheets must be stored in a large number of individual boxes. However, many printing devices are specifically designed to accept only stacked, pre-cut sheets of paper. The stack is fed by a deshingler that removes sheets from the stack and delivers them to the printing element. This deshingler operates slowly enough to accommodate the necessary timing of print operations. However, without the deshingler to regulate feeding, the printer cannot generally operate continuously unless some other method of regulating paper feed is provided.

Previous devices, by for instance, Hunkler of Switzerland, have dealt with the problem of providing a continuous roll source of paper to a printer, designed only for use with stacked paper sheets, by continuously cutting and adding additional sheets from the roll to this input paper stack feed unit. This method has been particularly adapted for the Xerox™ 87xx and 97xx series such as the 9700 Laser Printer, and for various duplicators. The problem with this method is that the printer must still deshingle and individually feed sheets of paper from the stack feed unit. The result is increased, rather than decreased overall complexity and a greater chance of system failure due to the need to now accurately cut and stack paper sheets from the roll as well as to subsequently unstack the sheets of paper to feed them to the printer.

Other prior art devices also particularly directed toward the Xerox™ 9700 have eliminated the need for shingling and deshingling of paper, thus allowing direct feeding, by modifying the operating software of the printer so that its timing of operation will match that of the feeding device. The problem with such an approach is that the feeding device has lessened versatility with respect to other machines while installation time and expense are increased due to the need to modify software in the printer.

SUMMARY OF THE INVENTION

It is therefore an object of this invention to provide a unique system and method for continuously feeding a printing device from a continuous roll of paper material.

It is another object of this invention to provide a system and method for feeding a printing device that requires no alteration to the operating software of the device.

It is another object of this invention to provide a system and method for feeding a printing device that allows sheets of various sizes and shapes to be accurately fed and printed upon.

It is another object of this invention to provide a system and method for feeding a printing device that requires no shingling or deshingling of the paper between the source and the printer's image conducting belt or drum.

It is another object of this invention to provide a system and method for feeding a printing device that may be attached and detached from the printing device quickly and forms part of a modular system that includes a plurality of different feeding devices.

It is yet another object of this invention to provide a system and method for feeding a printing device that is specifically applicable to the Xerox™ 9700 Laser Printer, but may also be adaptable to a variety of other printers.

This unique invention provides a system and method for directly feeding unstacked paper sheets into a printing device having movage image conducting element with a plurality of images for transfer to the paper placed thereon and also having a wait station for controlling the timing of paper transfer to the image conducting element. The system comprises a means for directing a continuous stream of paper sheets to a printing device wait station. There is a means for controlling the rate of movement of the paper sheets into the wait station to present each paper sheet at a programmed or otherwise predetermined time relative to the operating speed of an image conducting element of the printing device. Means are provided for regulating the spacing of a leading edge of each paper sheet as it is presented to the wait station. This spacing is relative to the spacing between consecutive images on the image conducting element.

In one embodiment, the printing device is a laser printer and the image conducting element is one of either a constant speed belt or drum, upon which, images are placed for transfer. This system may be particularly adapted to a Xerox™ 9700 series laser printer. There may be provided a means for controlling the rate of paper sheet feeding that includes a predetermined rate equal to approximately 20 inches per second and a means for regulating the spacing of fed paper sheets that includes a spacing equal to approximately 10 inches. The system may also comprise a means for cutting the paper sheets to predetermined sizes from the input of a continuous paper web. This continuous paper web may be input from a roll. There may be included in this system a means for driving the roll in synchronization with the means for directing the paper sheets so that each cut paper sheet proceeds without delay to the wait station. The means for regulating paper spacing may include a means for detecting the leading edge of each paper sheet.

In an alternative embodiment a system for directly feeding sheets to a printing device according to this invention provides a means for bypassing a printer stack feeding storage unit that includes a table for guiding sheets in a downstream direction into the stack deshingler. The stack deshingler itself is a unit that removes sheets one at a time and positions the sheets within a wait station means which, itself, feeds these sheets to an image transfer element upon demand of the image transfer element. The table includes a means for detecting movement of each sheet upon the table through the stack deshingler and into the image transfer element and/wait station. There is additionally provided on the table a means for sensing the absence of a sheet proximate the stack deshingler. The table further includes a means for driving sheets therealong from an upstream side to the stack deshingler in response to the absence of a sheet at the means for sensing. Sheets are provided at the upstream side of the table to the means for driving in response to at least one or both of the means for sensing absence of sheets and means for detecting movements of sheets. In particular, the sheets provided to the upstream side of the table may originate from a roll source of continuous web that is cut on demand in response to the detection of movement of sheets through the deshingler. Sheets are continuously driven into the cutter to lay partially upon the table in response to the sensing of the absence of sheets as they are fed to the image transfer element. The roll source, the cutter feeder, and particularly the table may include wheels to allow their motion to and from the printer. Each of these units is modular and may be operated without any specific electronic interconnection with the printer.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENTS

Figure 1:
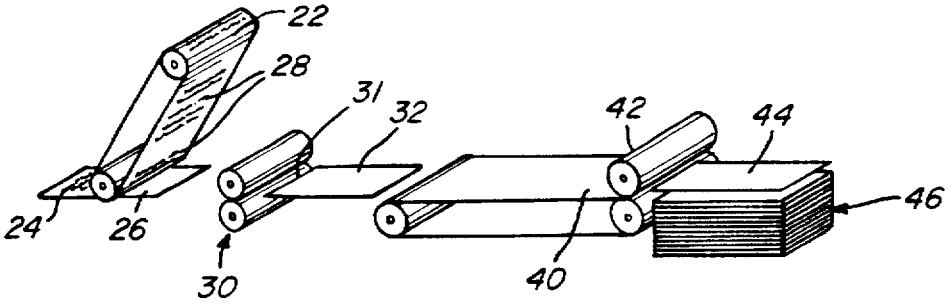
Fig. 1 (PRIOR ART)
FIG. 1 is a schematic illustration of a prior art method of feeding paper requiring deshingling of stacked sheets.

A photoreprographic printing system of the prior art is generally depicted in FIG. 1. This type of printing system is used, for example, in the Xerox™ 9700 Series Laser Printer. It generally consists of an image conductor element 22 comprising either a belt or drum upon which printing toner is placed in the form of the desired print images. The image conductor belt 22 shown herein contains several images 28 that are laid down at 24 upon a piece of paper 26 as it passes under the contacting surface of the belt. Each piece of paper is fed to the image element by means of a "wait station" 30. This wait station includes a pair of rollers that forcibly drive a sheet of paper into the image element at a given time corresponding to the motion of the image conductor belt. The wait station 30 is synchronized to drive the leading edge 31 of a sheet of paper 32 into the image conductor belt each time an image on the image conductor belt 22 is aligned to properly print upon the sheet of paper when it reaches the image conductor belt. The feeding of the wait station, as shown in FIG. 1, is accomplished in most printer systems by deshingling a stack of paper 46, one sheet at a time, and feeding each sheet 44 at a predetermined rate to the wait station 30, using a feed driving belt and pinching roller 40 and 42, respectively. As each sheet is fed to the wait station it is held for a small interval until the image element is again ready to receive a new piece. If the wait station does not receive a new piece of paper by the time the next image is ready to be printed, the system will shut down displaying a jam or paper refill signal.

Figure 2:
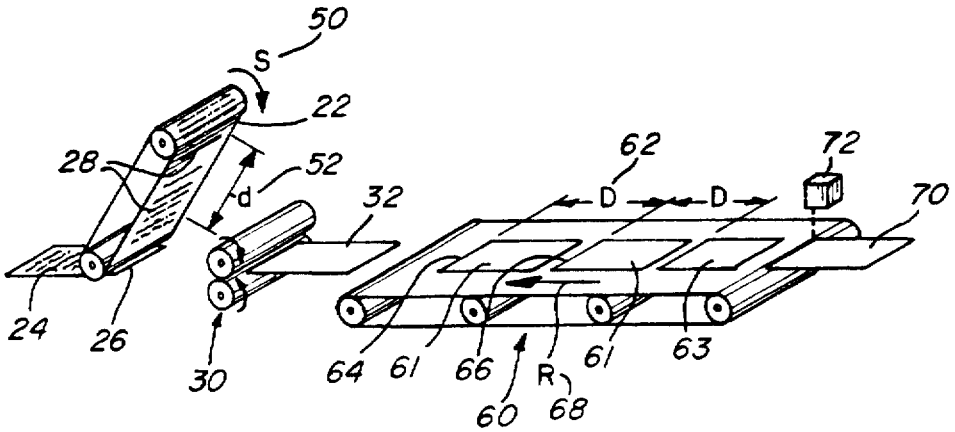
FIG. 2 is a schematic illustration of a direct feeding system according to this invention.

Any feeding system that correctly interfaces with this type of printer must be able to directly feed the wait station of the printing element so that it receives a sheet of paper within the correct period of time to prevent the wait station from indicating an error. Also, it must not feed too quickly since this would cause a feeding backlog at the wait station. Reference is now made to a direct feeding system as depicted in FIG. 2 and as in accordance with the present invention. In this schematic drawing, paper sheets 70 are fed to a conveying or feeding 60 that moves paper at a specific rate R 68 to the wait station 30. Each sheet is delivered to the station 30 at a specific point of time in order to insure that it be fed to the image conducting belt 22 in synchronization with the print images laid down on the belt. In order to insure that this precise synchronization be obtained, the parameters of image conducting belt speed S 50 and the distance between the leading edge of each new image d 52 on the image conducting belt is determined. These parameters are directly relative to the feeding speed. In the example of a Xerox™ 9700 Laser Printer, the image belt speed is 20 inches per second and the distance between each image leading edge D is 10 inches. As such, the system 60 is designed to separate each leading edge of input paper sheets by a distance D 62 that equals the image conducting belt image distance d 52. In this case, the distance is 10 inches.

In FIG. 2 the leading edges 64 and 66 of each paper sheet 61 are separated by the distance D. This spacing may be accomplished by detecting at 72 the leading edge of a sheet each time a sheet is presented to a feeding mechanism or conveyor 60. Each sheet is motioned down the feeding mechanism 60 when the appropriate distance from the preceding leading edge has been attained. Furthermore, each sheet of paper driven at this distance D travels down the feeding mechanism at a fixed rate R 68. In this example, the rate R will equal 20 inches per second, or the rate of the image conducting belt. The advantage of such a leading edge detect system is that various sizes of paper may be aligned to print accurately since each sheet is fed accurately with timing of feed based solely upon its own leading edge. As shown in FIG. 2, the second sheet 61 and third sheet 63 are of different sizes while each sheet's leading edge is aligned at precisely the same distance from the preceding one. This novel system only allows the next sheet to begin motion when the preceding leading edge has traveled exactly a distance D from the next sheet's leading edge. Since printing may occur without regard to size, the printing of unfolded envelopes, among other applications, is possible in large unstacked volume.

Figure 3:
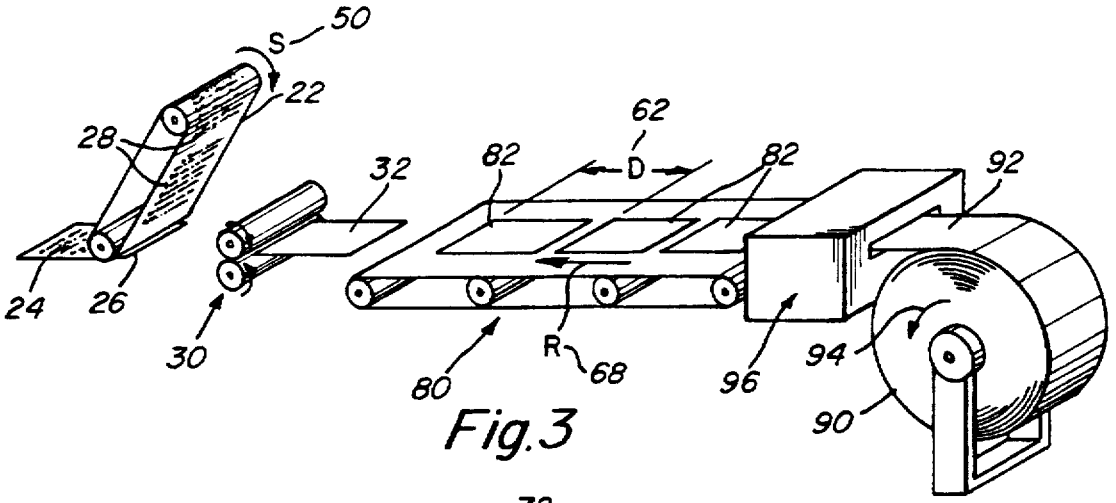
FIG. 3 is a schematic illustration of the direct feeding system of FIG. 2 including a paper feeding roll and sheet cutting device for increased production volume.

A significant feature of the direct feeding concept is the ability to input a continuous web of paper to the printing system. A roll 90 of paper web 92 is shown in FIG. 3. This paper web 92 is fed in a continuous manner into a cutting unit 96. The cutting unit 96 cuts sheets to a programmed or otherwise predetermined size sheet 82 that are then driven down the feeding device 80 with the required spacing D 62. The sheets are then delivered by the feeding mechanism or conveyor 80 to the wait station 30 and printed upon in the manner described herein above. The feed rate of the roll 94 to the cutting device 96 is synchronized to the general feed rate of the feeding mechanism 80. If so, each time a sheet is cut it may proceed on to the feeding device without delay.

In accordance with the invention, the station 30 may operate continuously assuming that the spacing D is proper as introduced to the station 30. Alternatively, the station 30 may operate somewhat intermittently with a slight wait possible for proper synchronization. Sheets can be provided early to the station 30 but cannot be provided late as this would cause a malfunction and shut-down.

As indicated previously, in accordance with the present invention, each sheet of paper, such as illustrated in FIG. 2, is carried by the feeding mechanism or conveyor 60 once the appropriate distance from the preceding leading edge has been attained. Assuming that the feeding mechanism 60 is set up for operation at a programmed or otherwise predetermined speed to match that of the image conducting belt 22, then one can employ a leading edge detector to determine the presence of a leading edge of a sheet being fed to the feeding device 60. Once this leading edge is detected, the input feed to the feeding mechanism 60 can be interrupted until the proper spacing occurs, namely the spacing D in FIG. 2 at which time the input feed proceeds so that all leading edges are spaced the proper programmed distance, namely distance D in FIG. 2.

By way of further example, there can be separate feeding mechanisms, including an origination feeding mechanism and a feeding mechanism such as the conveyor-like feeding mechanism 60 shown in FIG. 2. The leading edge detector would, in essence, be between these two feeding mechanisms and would in essence take input sheets fed in a serial course that might be unsynchronized positionally and essentially convert the sheets into a synchronized positional arrangement on the feeding mechanism 60. Again, this occurs by detecting leading edges on the input feed mechanism and then permitting the sheets to be fed to the feeding mechanism 60 but only once the proper spacing D has been achieved.

Figure 4:
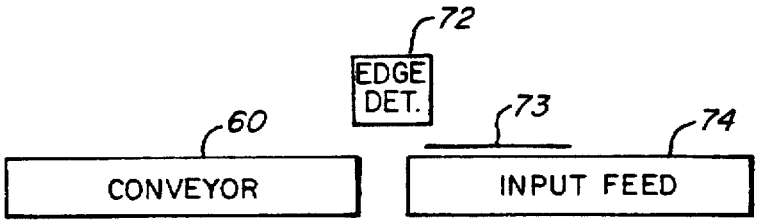
FIG. 4 schematically illustrates an edge detector used with the feed mechanism in accordance with the present invention.

Now, with regard to the synchronization of sheets onto the feeding mechanism or conveyor 60, refer to FIG. 4 which is a schematic diagram illustrating the conveyor 60 as well as an input feed 74, and edge detector 72, and a typical sheet 73. The sheet 73 is fed on the input feed. The edge detector 72 detects an edge of this sheet and essentially holds the sheet in readiness for the conveyor 60 moving to a particular position at which time the sheet 73 continues to be fed onto the conveyor 60 with the proper spacing between sheets as illustrated in FIG. 2 by the spacing D.

Figure 5:
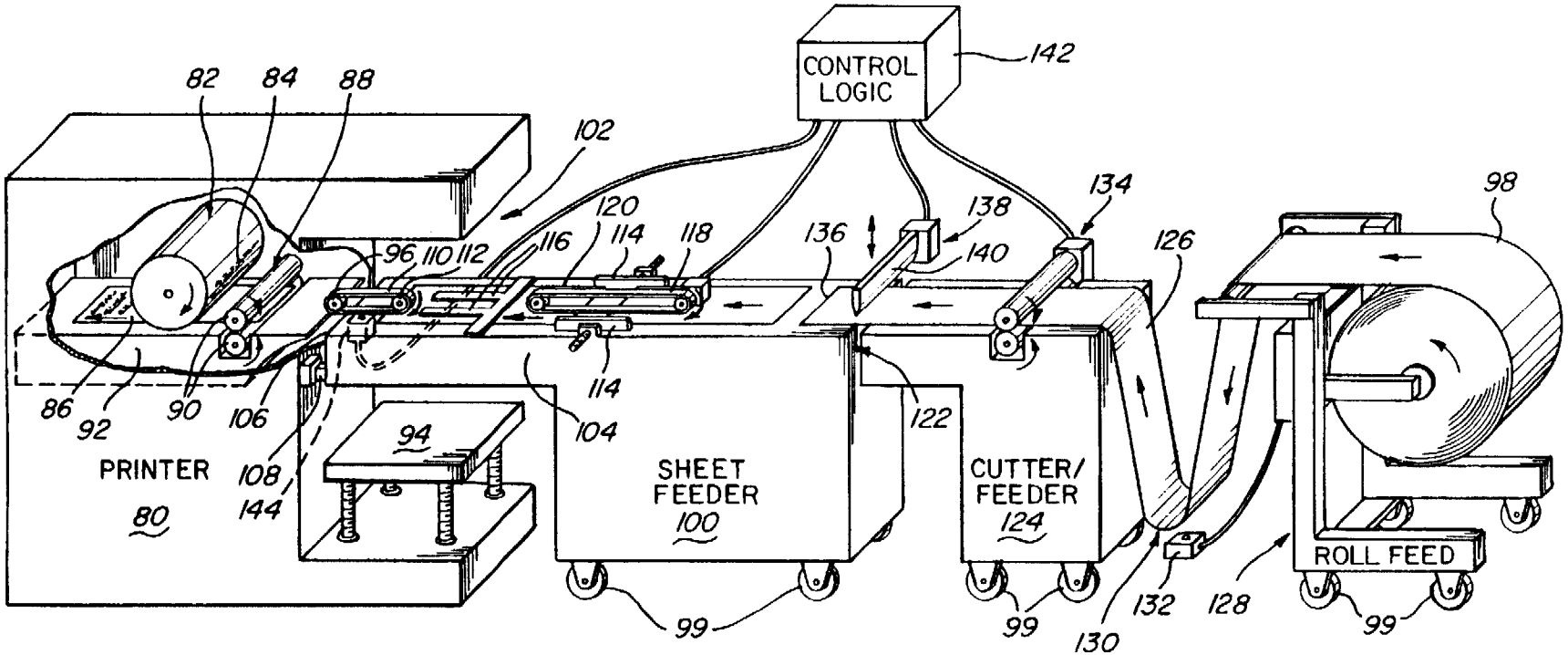
FIG. 5 is schematic illustration of another embodiment of a modular direct feeding system according to this invention.

An alternative embodiment of a sheet feeding system according to this invention is depicted somewhat schematically in FIG. 5. The system includes a printer 80 such as the Xerox™ 9700 Laser Printer having an image element 82 that revolves to place toner in the form of text 84 upon sheets 86 passed thereunder. As described above, the image element 82 rotates continuously and when the text 84 on the element 82 is circumferentially positioned in alignment with a leading edge of a sheet, the sheet is then advanced through the image element by means of the "wait station" 88. The wait station 88 in this example is a pair of pinch rollers 90 that hold the sheet 86 until the proper synchronization of image element text to sheet position is obtained. The sheet 86 is then advanced downstream by the wait station rollers 90 along a printer feeding table 92 so that it converges with the text-carrying portion of the image element at the proper time. In this way, text is accurately laid upon the appropriate section of the sheet. After a sheet passes from the wait station 88 through image element 82, the wait station 88 is then free to receive another sheet which it will hold until the image element again rotates to place the text in a proper position in which to begin driving the next sheet into convergence with the image element 82.

Normally, as depicted in FIG. 1, sheets are deshingled from a stack which, in this embodiment, is supported on an upwardly moving base 94 that is built into the printer 80. In this embodiment, the deshingler itself comprises elastomeric wheel 96 that projects over an edge of the printer feeding table. In a normal stack feeding operation, sheets would be driven upwardly by the base 94 to the level of the printer feeding table 92, as sheets were removed by the deshingler wheel 96, so that a top sheet in the stack would remain in contact with the deshingler wheel 96. The deshingler wheel 96 would be commanded to rotate to drive the sheet into the wait station 88 sometime soon after a prior sheet had moved downstream, clearing the wait station 88, and had been driven through the image element 82. Thus, the wait station 88 would always have a reserve deshingled sheet to present to the image element 82 at the appropriate time.

As stated previously, however, a printer that utilizes only stack feeding must be refilled quite frequently. It would be desirable, instead, to continuously and directly feed sheets to the wait station from a much larger source than an integral stack feeder. In this embodiment, a source derived from a roll 98 of continuous web is utilized. Such a source may contain many times the number of sheets as a typical printer storage stack.

A modular system is utilized for feeding sheets from the roll source 98 according to this embodiment. Each separate unit of the system may, thus, be attached to and detached from the printer 80 and each other without substantial alteration of the printer's working components or operating software. Rollers or wheels 99 are provided for portability. In particular, a modular sheet feeder 100 according to this invention, having wheels for portability, is mounted into the preexisting stack feed access port 102 of the printer 80. the sheet feeder 100 is constructed with a table 104 that aligns with and is level with the printer feeding table 92 and has a downstream edge 106 that stands directly below the deshingler wheel 96. Thus sheets may pass unimpeded from the sheet feeder's table 104 to the printer feeding table 92. The sheet feeder 100 may include guiding lugs 108 or similar locking elements that help to maintain the sheet feeder module 100 in alignment with the printer 80.

In this embodiment, the printer 80 has been modified to include an extended drive belt 110 and idler roller 112 that are rotatably connected to the deshingler wheel and that further overlap the table 104 of the feeder 100. Note that the feeder's table 104 is elevated in the region of the stack base 94 so that it effectively bypasses (bridges) the stack base 94 and enables the transfer of a horizontal stream of sheets one at a time directly to the deshingler assembly 96, 110, 112 and wait station 88 units from outside the normal bounds of the printer housing. The primary substantive alteration to the normal printer functioning in this embodiment is the extending of the deshingler wheel 96 which may be accomplished by a simple attachable and detachable component that includes the belt 110 and idler roller 112.

The sheet feeder 100 itself includes movable side edge guides 114 to maintain sheets in appropriate transverse alignment as they are fed. It further includes, in this embodiment, a pair of spring loaded strips 116 to lightly maintain the sheets flatly against the table 104.

Operation of the sheet feeder 100 is accomplished by means of a drive or conveyor belt 118 disposed somewhat pressurably, opposite the surface of the table 104 to contact and transfer sheets (120) on demand from a sheet feeder upstream or input side 122 to the deshingler. The belt 118 may be slightly angled relative to the feeding direction to force sheets accurately up against an edge guide 114. The accurate driving of the belt 118 to transfer sheets downstream may be accomplished using, for example, a stepper or servo motor or a ratchet clutch. This process will be described further below.

Sheets are formed at the upstream input edge 122 of the feeder 100 by means of a cutter feeder apparatus 124 that draws a continuous web 126 from the roll feed/unwind unit 128. The roll feed/unwind unit 128 itself provides web upon demand of the cutter/feeder by means of a constant size loop 130 of web. This loop 130 is maintained at a constant size by means of a loop detector 132 that signals driving of the roll feed unit 128 as it becomes smaller due to cutter/feeder 124 drawing of web 126. One such roll feed unit for providing web upon demand is Applicant's Roll Support and Feed Apparatus, U.S. Pat. No. 4,893,763.

Continuous web 126 is drawn from the roll feed unit loop 130 specifically by means of a pair of driving rollers 134 or similar conveyors (such as pin feed conveyors) that bias the leading edge 136 of the web 126 downstream through a cutter 138. The precise distance of biasing depends upon the size of sheet selected. In general, the cutter/feeder 124 meters out a length of web equal to the programmed sheet length. The trailing (upstream) edge of this metered length finds itself under the blade 140 of the cutter 138 while the leading edge 136 is disposed upon the table 104 the sheet feeder 100.

The modular and independent functioning of the system, separate from any direct control by the printer, is based upon the controlling of each of the sheet feeder 100 and cutter/feeder 124 independently of the printer 80 using a separate control logic circuit 142 that interconnects each of the systems operating elements. Control is based primarily upon at least one table 104 mounted detector 144 that senses the state of a sheet relative to the image element 82 and wait station 88 in order to instruct the system. note that the sensing occurs without directly tapping into printer operating functions. The functioning of the system based upon the control logic circuit 142 is described further in FIGS. 6–9.

The operation of the system according to FIGS. 6–9 is depicted at various states. These figures illustrate the process in an on-going manner in which the initialization of feeding has already occurred. Arrows show the operation of various elements and the timing of such operation.

Figure 6:
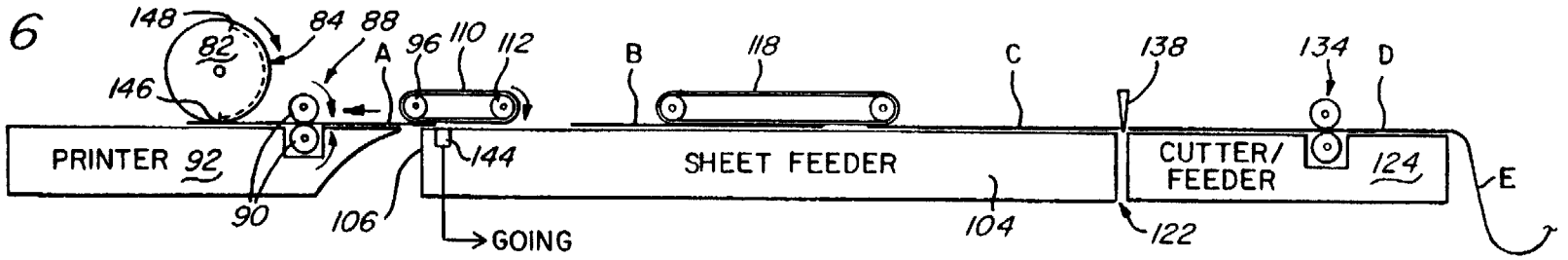
FIGS. 6–9 show schematically the movement of sheets during different operating states of the modular feeding system of FIG. 5.

FIG. 6 shows a sheet A being driven in a downstream direction by the rollers 90 of the wait station 88 into contact with the image element 82. The image element 82 contains text 84 along its circumference between two points 146, 148. In this embodiment, the image element 82 moves at a constant rate throughout the feeding process without stopping as long as it is instructed to continue printing. The trailing (upstream) edge of the sheet A passes under the deshingler roller and the attached belt and idler roller. Note that the deshingler roller usually includes a one-way clutch so that when the wait station rollers begin their rapid driving of the sheet, no resistive drag is imparted by the generally slower moving deshingler roller.

A second sheet B is positioned upstream of sheet A in a stationary position at the sheet feeder drive belt 118. This sheet is awaiting complete feeding of sheet A into the image element 82. A sheet C is also positioned on the sheet feeder table 104 near the input side 122 thereof. This sheet (C) is stationary, resting partially within the cutter/feeder 124 and partially within the sheet feeder. It is in the process of being cut from a continuous web D and E which extends upstream of the cutter/feeder 124. The rest of the input web D and E is likewise, stationary while the sheet A is being transferred into the image element 82 by the wait station 88.

A detector 144, which in this example is positioned proximate the downstream end 106 of the sheet feeder table 104 detects movement of sheet A into the image element 82. As a result of the presence of a moving sheet, the detector signals a "GOING" condition to the control logic 142 of FIG. 5. The control logic 142, thus, signals the cutter 138 to immediately separate input sheet C from the remainder of the continuous web D and E. Sheet C is, thus, fully separated from the web and ready to be pulled by the upstream end of the drive belt 118 at the appropriate time.

Figure 7:
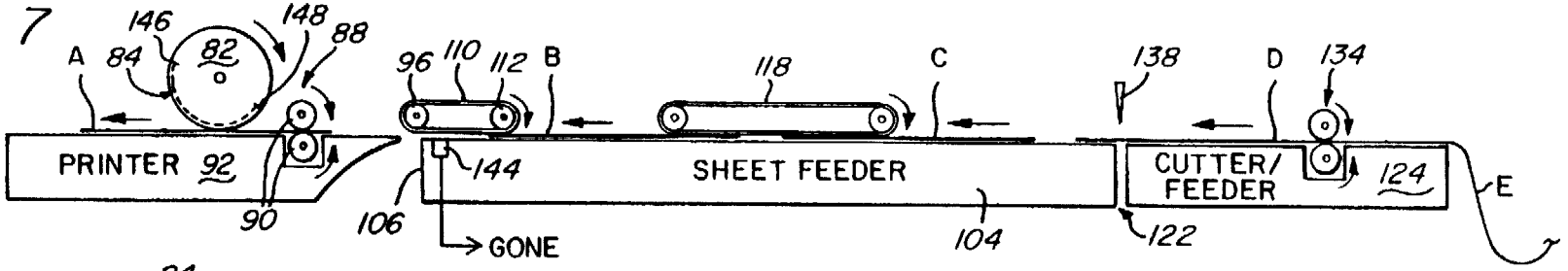

The subsequent movement of each of the upstream disposed sheets following the transfer of sheet A is accomplished as shown in FIG. 7. Once sheet A has cleared the sheet feeder table 104 and has passed substantially through the image element 82 and wait station 88, the detector 144 of this embodiment senses the absence of a sheet. This absence is translated into a "GONE" signal to the control logic 142. The control logic 142, in response to a "GONE", signals the cutter/feeder 124 and the sheet feeder drive belt 118 to translate over a distance sufficient to transfer sheet B into the deshingler belt assembly 96, 110, 112 and simultaneously transfer sheet C to the position formally occupied by sheet B, just upstream of the deshingler assembly. Similarly, the rollers 134 of the cutter/feeder 124 feed the leading (downstream) edge of the continuous web D and E onto the sheet feeder.

Figure 8:
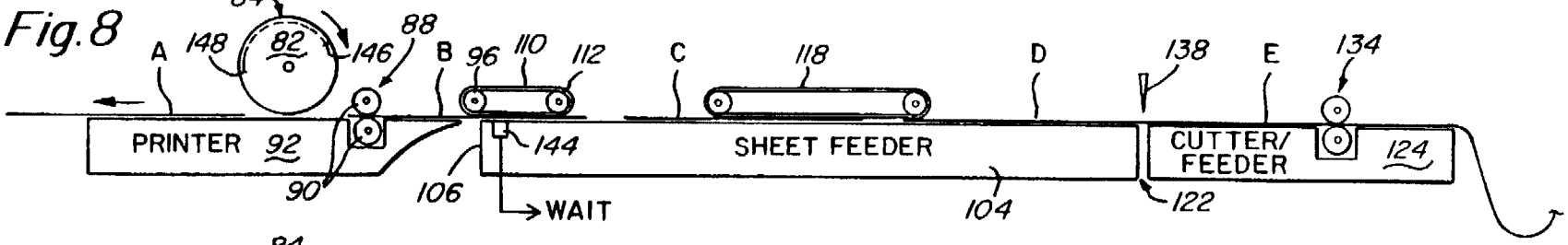

The completed repositioning (shown in progress in FIG. 7) of sheets is depicted in FIG. 8. Sheet B is now positioned within the wait station rollers 90 with its leading edge slightly (approximately one inch thereof) protruding downstream while sheet C stands in the belt 118, ready to be fed to the deshingler assembly 96, 110, 112 and sheet D now stands with its downstream leading edge partially under the feeder drive belt and its uncut upstream trailing edge located proximate the cutter. At this time, sheet D is still part of the continuous web E within the cutter/feeder. Note that while all other elements are stationary, the image element continues to rotate with the circumferential text image 84 not yet in synchronization with the next sheet B. The printer will again signal driving of the wait station rollers 90 only when the image 84 has rotated to the proper position to effect synchronized convergence of a driven sheet B with the image 84. Since sheet A has been completed, it is shown exiting the printer feeding table 92.

In the system state depicted in FIG. 8, each module of the system of this invention remains stationary awaiting proper alignment of the image element 82. Until such time, the wait station rollers 90 hold sheet B in a stationary unfed position. Note that the wait station rollers 90 are dependent for their movement directly upon the positioning of the image element 82 and are an integral part of the printer mechanism. Thus, since sheet B's movement is now dependent upon the wait station movement, the sheet in this state is stationary. As such, the detector 144 senses the presence of a non-moving sheet therein. The detector, consequently, signals a neutral or "WAIT" state in which the logic control 142 (FIG. 5) directs each of the sheet feeder belt 118 and cutter/feeder unit 124 to neither advance nor cut sheets.

Figure 9:
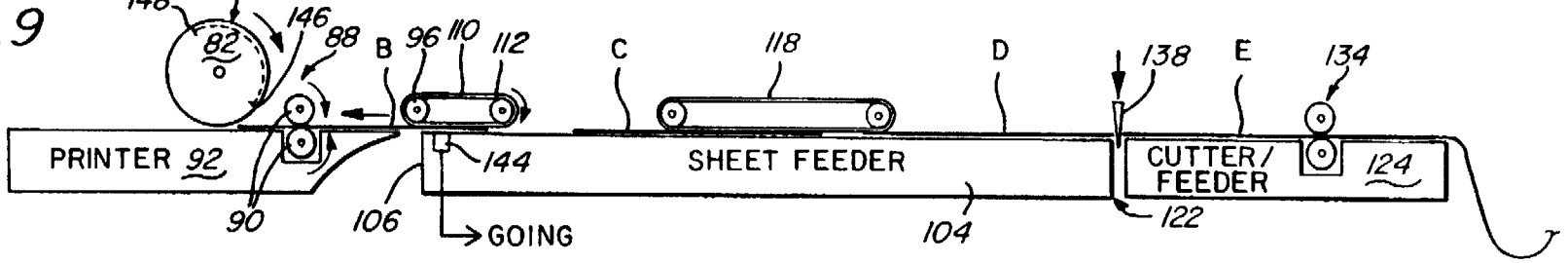

Once the image element 82 becomes positioned at the proper alignment point for printing text, the printer then signals the wait station rollers 90 to begin driving sheet B as depicted in FIG. 9. As such, the detector 144 now again signals a "GOING" state to the control logic 142 which instructs the cutter 138 to cut sheet D from the previously positioned downstream end of the continuous web E. Again, once sheet B clears the detector 144, a "GONE" state is signaled which causes the logic 142 to instruct the system to feed sheets C, D and E downstream. This cycle continues until the printer image element 82 is instructed to cease printing operation. At this time a final fed sheet may remain at the ready in the wait station 88 until the next print instruction causes the image element 82 to restart.

The elements of the cutter/feeder 124 and driving belt 118, in general, operate fast enough to insure that sheets are delivered to the deshingler as fast or faster than they are required. Otherwise, the printer may signal a jam or out of paper condition and cease operation.

Note that while one sheet feeder drive belt is shown according to this embodiment, two or more drive elements acting in concert may be utilized according to this unique invention. Similarly, the sheet feeder may carry two or more sheets along its table at any one time between the cutter 138 and the deshingler assembly 96, 110, 112. Each movement of a sheet into the image element would cause the advance of each of the plurality of sheets upon the table downstream by one, with a constant number of sheets always remaining on the table at any one time. Similarly, more than one detector may be utilized. The detectors may be positioned spaced from each other along the sheet feeder table. Each of the detectors would detect the presence or absence of a sheet, with the more upstream signaling a going state in the absence of a sheet and the more downstream signaling a gone state in the absence of a sheet. Detectors could function based upon infrared, ultrasonic or electromechanical mechanisms according to this invention. The system of this embodiment, in general, should detect the current operating state of the image element and wait station by means of its drawing of sheets and determine the position of each of the sheets fed thereinto in order to properly form and advance upstream sheets to the printer at the proper time.

It should be understood that the preceding is merely a detailed description of preferred embodiments. It will be obvious to those skilled in the art that various modifications can be made without departing from the spirit or scope of the invention. The preceding description is meant to be taken only by way of example and to describe only preferred embodiments and not to limit the scope of the invention.

What is claimed is:

1. An apparatus for feeding sheets to an input port of a printer or other utilization device, the sheets being fed along a single predetermined feed path, the apparatus comprising:

a source of sheets;

a support structure having an upstream end and a downstream end and defining the single predetermined feed path;

a drive mechanism that selectively moves the sheets individually on the support structure along the predetermined feed path from the upstream end to the downstream end and toward the input port;

a sensor that generates signals indicating one of the following position states of a sheet at the downstream end relative to the input port:

(i) a GOING state at which the sensor detects movement of the sheet, when the sheet is being drawn at the input port;

(ii) a GONE state in which the sensor detects the absence of the sheet, when the sheet has gone into the input port of the printer or other utilization device; and (iii) a WAIT state in which a predetermined time is to elapse during which a sheet advances fully downstream to the input port; and a controller, responsive to the position state signals of the sensor, that controls the drive mechanism to maintain an upstream position sheet in a substantially stationary position in response to a WAIT signal of the sensor indicating movement of a downstream position sheet to the input port, and to drive the upstream position sheet to advance to a predetermined waiting position and readiness for introduction to the input port in response to a GONE signal of the sensor system indicating that the downstream position sheet has reached a more downstream position within the input port.

2. The apparatus as set forth in claim 1 further comprising a cutting assembly disposed proximate to the upstream end of the feed path, the cutting assembly including a continuous web and a cutter for separating individual sheets of a predetermined length from the continuous web, and the controller is constructed and arranged to operate the cutter responsive to the position state signals of the sensor subsequent to a driving of the downstream end of the continuous web onto the upstream end of the support structure so that a cut sheet is formed at the upstream end of the support structure, the controller operating the cutter in response to the GOING signal of the sensor upon the driving of the downstream position sheet into the input port.

3. The apparatus as set forth in claim 2 wherein the support structure is constructed and arranged to support at least three sheets thereon, the controller operating the drive mechanism to transfer a sheet at the upstream end of the support structure, adjacent the cutter, to an intermediate location on the support structure between the upstream end and the downstream end thereof, and a sheet at the intermediate location of the support structure being substantially simultaneously transferred by the drive mechanism downstream into the input port, the transfer of each of the sheets being in response to the absence of a sheet adjacent the downstream end of the support structure.

4. The apparatus as set forth in claim 1 wherein the support structure comprises a portable module constructed and arranged to be detachably engaged to the input port, and wherein the input port is constructed and arranged to receive sheets from a stack of cut sheets, the support structure being positioned in a location normally occupied by a top sheet of the stack.

5. The apparatus as set forth in claim 4 wherein the sensor system includes a sheet presence sensor at the downstream end of the support structure and wherein the controller and the input port are free of electronic communication therebetween and wherein the controller controls operations based only upon a sensing state of the sheet presence sensor.

6. The apparatus as set forth in claim 1 further comprising adjustable guides located on the support structure for guiding widthwise edges of sheets passing therealong, the guides being adjustable in a direction substantially transverse to the upstream-to-downstream direction.

7. A method for feeding sheets to an input port of a utilization device using a supporting structure that communicates with the input port and on which the sheets are directed from an upstream end to a downstream end to await drawing thereof into the input port, comprising the steps of:

advancing each of the sheets from the downstream end of the supporting structure for drawing into the input port at a first time in synchronization with movement of an operative element of the utilization device to thereby perform an operation on selected of the sheets with the operative element;

providing a continuous web of sheets to the upstream end of the supporting structure;

cutting separate sheets of a predetermined length from the continuous web, and performing the cutting responsive to sensing the drawing of a downstream sheet into the input port; and driving each of the separate sheets, asynchronously relative to the step of drawing, in a downstream direction to the downstream end of the supporting structure at a second time between each first time to await the step of drawing at each first time, the step of driving including sensing a drawing of each of the sheets from the downstream end into the input port to thereby instruct driving of each of the sheets to the downstream end of the supporting structure adjacent the input port at each second time.

* * * * *